US007345560B2

(12) United States Patent
Laskaris et al.

(10) Patent No.: US 7,345,560 B2
(45) Date of Patent: Mar. 18, 2008

(54) METHOD AND APPARATUS FOR MAGNETIZING A PERMANENT MAGNET

(75) Inventors: Evangelos Trifon Laskaris, Niskayuna, NY (US); Liang Li, Niskayuna, NY (US); Kathleen Melanie Amm, Clifton Park, NY (US); Juliana Chiang Shei, Niskayuna, NY (US); Bulent Aksel, Clifton Park, NY (US); Mark Gilbert Benz, Burnt Hills, NY (US); Gerald Burt Kliman, Niskayuna, NY (US); Paul Shadworth Thompson, Stephentown, NY (US); Israel Samson Jacobs, Niskayuna, NY (US); Harold Jay Patchen, Glenville, NY (US)

(73) Assignee: General Electric Company, Schenectady, NY (US)

( * ) Notice: Subject to any disclaimer, the term of this patent is extended or adjusted under 35 U.S.C. 154(b) by 509 days.

(21) Appl. No.: 10/682,574

(22) Filed: Oct. 10, 2003

(65) Prior Publication Data

US 2004/0074083 A1 Apr. 22, 2004

Related U.S. Application Data

(60) Division of application No. 09/897,040, filed on Jul. 3, 2001, now Pat. No. 6,662,434, which is a continuation-in-part of application No. 09/824,245, filed on Apr. 3, 2001, now Pat. No. 6,518,867.

(51) Int. Cl.
*H01F 13/00* (2006.01)

(52) U.S. Cl. ..... 335/284; 361/147; 361/148

(58) Field of Classification Search ..... 335/284, 335/296–301; 361/143–156
See application file for complete search history.

(56) References Cited

U.S. PATENT DOCUMENTS

| | | | | |
|---|---|---|---|---|
| 3,899,762 | A | | 8/1975 | Studders |
| 4,039,853 | A | * | 8/1977 | Koizumi et al. ..... 307/101 |
| 4,354,218 | A | * | 10/1982 | Steingroever et al. ..... 361/147 |
| 4,496,395 | A | | 1/1985 | Croat |
| 4,540,453 | A | | 9/1985 | Boredelon et al. |
| 4,667,123 | A | | 5/1987 | Denk et al. |
| 4,672,346 | A | | 6/1987 | Miyamoto et al. |
| 4,679,022 | A | | 7/1987 | Miyamoto et al. |
| 4,741,094 | A | | 5/1988 | Denk et al. |

(Continued)

FOREIGN PATENT DOCUMENTS

JP 09131025 A * 5/1997

OTHER PUBLICATIONS

U.S. Appl. No. 10/309,146.

(Continued)

*Primary Examiner*—Ramon M. Barrera
(74) *Attorney, Agent, or Firm*—Foley and Lardner LLP

(57) ABSTRACT

A method of making a permanent magnet body is provided. The method includes providing a first precursor body comprising a plurality of blocks and magnetizing the first precursor body to form a first permanent magnet body. A recoil magnetization pulse may be applied to the permanent magnet body after the magnetization. The precursor body may be heated during magnetization. A power supply containing a battery may be used to energize a pulsed magnet used to magnetize the precursor body.

12 Claims, 9 Drawing Sheets

U.S. PATENT DOCUMENTS 4,777,464 A 10/1988 Takabatashi et al.
4,810,986 A 3/1989 Leupold
4,818,966 A 4/1989 Miyamoto et al.
4,839,059 A 6/1989 Leupold
4,931,760 A 6/1990 Yamaguchi et al.
4,953,555 A 9/1990 Leupold et al.
4,998,976 A 3/1991 Rapoport
5,063,934 A 11/1991 Rapoport et al.
5,142,232 A 8/1992 Konishi et al.
5,204,628 A 4/1993 Konishi et al.
5,229,723 A 7/1993 Sakurai et al.
5,252,924 A 10/1993 Sakurai et al.
5,283,544 A 2/1994 Sakurai et al.
5,291,171 A 3/1994 Kobayashi et al.
5,317,297 A 5/1994 Kaufman et al.
5,320,103 A 6/1994 Rapoport et al.
5,332,971 A 7/1994 Aubert
5,343,180 A 8/1994 Fukumoto et al.
5,383,978 A 1/1995 Yamamoto et al.
5,400,786 A 3/1995 Allis
5,462,054 A 10/1995 Rapoport et al.
5,557,205 A 9/1996 Ohta et al.
5,621,324 A 4/1997 Ota et al.
5,623,241 A 4/1997 Minkoff
5,631,616 A 5/1997 Ohta et al.
RE35,565 E 7/1997 Sakurai et al.
5,680,086 A 10/1997 Allis et al.
5,774,034 A 6/1998 Yoneda et al.
5,825,187 A 10/1998 Ohashi et al.
5,852,393 A * 12/1998 Reznik et al. ..... 335/284
5,942,962 A 8/1999 Gery
6,120,620 A 9/2000 Benz et al.
6,130,538 A 10/2000 Carrozzi et al.
6,147,578 A 11/2000 Panfil et al.
6,150,911 A 11/2000 Katznelson et al.
6,157,281 A 12/2000 Katznelson et al.
6,163,240 A 12/2000 Zuk et al.
6,191,584 B1 2/2001 Trequattrini et al.
6,198,286 B1 3/2001 Trequattrini et al.
6,255,670 B1 7/2001 Srivastava et al.
6,259,252 B1 7/2001 Laskaris et al.
6,275,128 B1 8/2001 Aoki et al.
6,281,775 B1 8/2001 Rapoport
6,297,634 B1 10/2001 Aoki
6,311,383 B1 11/2001 Umeda et al.
6,313,632 B1 11/2001 Aoki et al.
6,333,630 B1 12/2001 Holsinger et al.
6,336,989 B1 1/2002 Aoki et al.
6,429,761 B2 8/2002 Laskaris et al.
6,448,772 B1 9/2002 Aoki
6,452,472 B1 9/2002 Aoki et al.
6,467,157 B1 10/2002 Livni et al.
6,489,872 B1 12/2002 Fukushima et al.
6,489,873 B1 12/2002 Kruip et al.
6,511,552 B1 1/2003 Makita et al.
6,518,754 B1 2/2003 Edwards
6,518,867 B2 2/2003 Laskaris et al.
6,525,634 B2 2/2003 Laskaris et al.
2002/0021129 A1 2/2002 Laskaris et al.
2002/0050895 A1 5/2002 Zuk et al.
2003/0011451 A1 1/2003 Katznelson et al.
2003/0011455 A1 1/2003 Wakuda et al.
2003/0016108 A1 1/2003 Aoki et al.

OTHER PUBLICATIONS

U.S. Appl. No. 10/309,139.

* cited by examiner

METHOD AND APPARATUS FOR MAGNETIZING A PERMANENT MAGNET

This application is a continuation-in-part of U.S. patent application Ser. No. 09/824,245, filed on Apr. 3, 2001, incorporated herein by reference in its entirety.

BACKGROUND OF THE INVENTION

This invention relates generally to methods and apparatus for magnetizing a permanent magnet, and specifically to magnetizing a magnet used in a magnetic resonance imaging (MRI) system.

There are-various magnetic imaging systems which utilize permanent magnets. These systems include magnetic resonance imaging (MRI), magnetic resonance therapy (MRT) and nuclear magnetic resonance (NMR) systems. MRI systems are used to image a portion of a patient's body. MRT systems are generally smaller and are used to monitor the placement of a surgical instrument inside the patient's body. NMR systems are used to detect a signal from a material being imaged to determine the composition of the material.

These systems often utilize two or more permanent magnets directly attached to a support, frequently called a yoke. An imaging volume is providing between the magnets. A person or material is placed into an imaging volume and an image or signal is detected and then processed by a processor, such as a computer.

The prior art imaging systems also contain pole pieces and gradient coils adjacent to the imaging surface of the permanent magnets facing the imaging volume. The pole pieces are required to shape the magnetic field and to decrease or eliminate undesirable eddy currents which are created in the yoke and the imaging surface of the permanent magnets.

The permanent magnets used in the prior art imaging systems are frequently magnet assemblies or magnet bodies which consist of smaller permanent magnet blocks attached together by an adhesive. For example, the blocks are often square, rectangular or trapezoidal in shape. The permanent magnet body is assembled by attaching pre-magnetized blocks to each other with the adhesive. Great care is required in handling the magnetized blocks to avoid demagnetizing them. The assembled permanent magnet bodies comprising the permanent magnet blocks are then placed into an imaging system. For example, the permanent magnet bodies are attached to a yoke of an MRI system.

Since the permanent magnets are strongly attracted to iron, the permanent magnet bodies are attached to the yoke of the MRI system by a special robot or by sliding the permanent magnets along the portions of the yoke using a crank. If left unattached, the permanent magnets become flying missiles toward any iron object located nearby. Therefore, the standard manufacturing method of such imaging systems is complex and expensive because it requires a special robot and/or extreme precautions.

The prior art permanent magnet bodies often do not have an ideal shape for use in an MRI system because the blocks may have a somewhat imperfect shape and/or may not perfectly fit together. An improperly shaped permanent magnet has poor field homogeneity and requires the addition of a large number of shims to improve the field homogeneity.

Furthermore, the characteristics of the prior art permanent magnet bodies sometimes change unpredictably during the operation of the MRI system. For example, the magnetization of the prior art permanent magnets sometimes changes unpredictably during the application of gradient fields when the MRI is operating. Thus, the prior art permanent magnets have been known to partially demagnetize during the application of the gradient field pulses.

In order to magnetize the prior art permanent magnet, a pulsed magnetic field is used. Usually the pulse energy required to magnetize a permanent magnet is very high. For example, the pulsed magnets are energized with a capacitor bank or an external power supply (i.e., a wall power outlet) used with a magnetically operated switch, which provide a pulsed current to the pulsed magnet. Thus, the magnetization process requires an expensive, complicated and energy consuming power source which is capable of providing a pulsed magnetic field of a sufficient power.

BRIEF SUMMARY OF THE INVENTION

In accordance with one preferred aspect of the present invention, there is provided a method of making a permanent magnet body, comprising providing a first precursor body comprising a plurality of blocks, and magnetizing the first precursor body to form a first permanent magnet body.

In accordance with another preferred aspect of the present invention, there is provided a method of making a permanent magnet body, comprising providing a first permanent magnet body having a shape suitable for use in an imaging system, and providing at least one recoil pulse to the first permanent magnet body.

In accordance with another preferred aspect of the present invention, there is provided a method of making a permanent magnet body, comprising providing a first precursor body, placing a pulsed magnet adjacent to the first precursor body, and magnetizing the first precursor body to form a first permanent magnet body by energizing the pulsed magnet from a power supply comprising at least one battery.

In accordance with another preferred aspect of the present invention, there is provided a pulsed electromagnet assembly, comprising a power supply comprising at least one battery, a switching circuit, and the electromagnet adapted to magnetize a permanent magnet precursor material.

In accordance with another preferred aspect of the present invention, there is provided a pulsed electromagnet assembly, comprising a power supply comprising at least one battery, a first means for magnetizing a permanent magnet precursor material, and a second means for switching the first means on and off.

In accordance with another preferred aspect of the present invention, there is provided a method of making a permanent magnet body, comprising assembling a plurality of blocks of unmagnetized precursor material to form a first precursor body, attaching the first precursor body to a support of an imaging device, heating the precursor body above room temperature, energizing a pulsed magnet from a power supply comprising at least one battery and applying a pulsed magnetic field to the first precursor body during the step of heating and after the step of attaching to convert the first precursor body to a first permanent magnet body, and applying at least one recoil pulse to the first permanent magnet body after the step of applying the pulsed magnetic field.

DETAILED DESCRIPTION OF THE INVENTION

Figure 1:
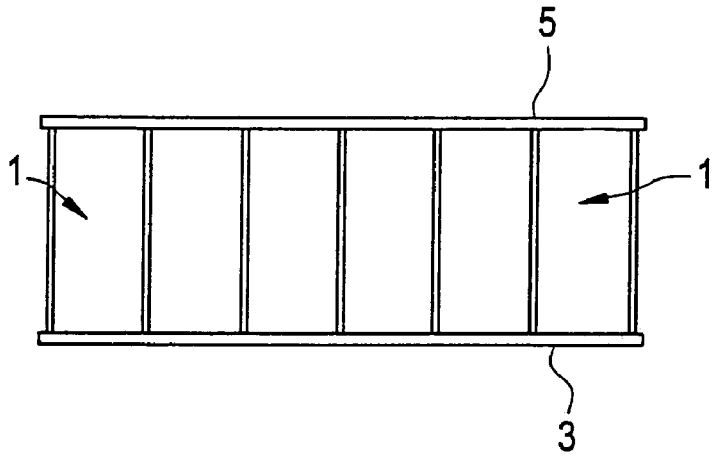
FIGS. 1-3 are side cross sectional views of a method of making a precursor body according to the first preferred embodiment of the present invention.

The present inventors have realized that the manufacturing method of a permanent magnet may be simplified if the unmagnetized blocks of permanent magnet precursor material are first assembled to form a precursor body, and then the precursor body is magnetized to form the permanent magnet body. Magnetizing the precursor alloy body after assembling unmagnetized blocks together simplifies the assembly process since the unmagnetized blocks are easier to handle during assembly. Special precautions need not be taken to prevent the blocks from demagnetizing if blocks of unmagnetized (or even partially magnetized) material are assembled. Furthermore, improved field homogeneity and reduced shimming time may be achieved by machining the precursor body into a desired shape for use in an imaging system prior to magnetizing the precursor body. Since the precursor body is unmagnetized, it may be readily machined into a desired shape without concern that it would become demagnetized during machining.

Preferably, the precursor body is magnetized after it is attached to the support or the yoke of the imaging system. In a preferred aspect of the present invention, the permanent magnets precursor body is magnetized by providing a temporary coil around the unmagnetized precursor body and then applying a pulsed magnetic field to the precursor body from the coil to convert the precursor body into the permanent magnet body. Magnetizing the precursor alloy body after mounting it in the imaging system greatly simplifies the mounting process and also increases the safety of the process because the unmagnetized bodies are not attracted to nearby iron objects. Therefore, there is no risk that the unattached bodies would become flying missiles aimed at nearby iron objects. Furthermore, the unattached, unmagnetized bodies do not stick in the wrong place on the iron yoke because they are unmagnetized. Thus, the use of the special robot and/or the crank may be avoided, decreasing the cost and increasing the simplicity of the manufacturing process.

The present inventors have also realized that the magnetization of the permanent magnets in an imaging system may be stabilized by applying a recoil pulse to the permanent magnet after it is magnetized. Thus, a precursor body having a shape suitable for use in an imaging system is first magnetized by applying a pulsed magnetic field having a first magnitude and a first direction to the first precursor body to convert the first precursor body to the first permanent magnet body. One or more recoil pulses are then applied to the permanent magnet body. The recoil pulse(s) has a second magnitude smaller than the first magnitude of the magnetizing pulses. The recoil pulse(s) has a second direction opposite from the first direction of the magnetizing pulses.

Furthermore, the present inventors have also realized that if the precursor body is magnetized at an elevated temperature, the energy required for magnetization may be reduced. Thus, the precursor body may be heated above room temperature during the step of magnetization.

The magnetization of the precursor body may also be improved by using a pulsed magnet assembly with a battery power supply for applying the pulsed magnetic field to the precursor body. By using a power supply containing one or more batteries, the cost, reliability, ease of operation and construction of the pulsed magnet used to magnetize the precursor body is improved. The pulsed magnet assembly contains a power supply comprising at least one battery, a switching circuit and an electromagnet adapted to magnetize a permanent magnet precursor material. The electromagnet is preferably a coil which contains no core, and which is adapted to fit around the precursor body, such that the precursor body acts as a core of the electromagnet during magnetization.

I. The First Preferred Embodiment: Post Assembly Magnetization

The method of making a permanent magnet body according to the first preferred embodiment will now be described. In this embodiment, the precursor body is magnetized after assembly. A plurality of blocks 1 of unmagnetized (or partially magnetized) material are assembled on a support 3, as shown in FIG. 1. The unmagnetized material may be any material which may be converted to a permanent magnet material by applying an anisotropic magnetic field of a predetermined magnitude to the unmagnetized material. Preferably, the support 3 comprises a non-magnetic metal sheet or tray, such as a flat, 1/16 inch aluminum sheet coated with a temporary adhesive. However, any other support may be used. A cover 5, such as a second aluminum sheet covered with a temporary adhesive, is placed over the blocks 1.

Figure 2:
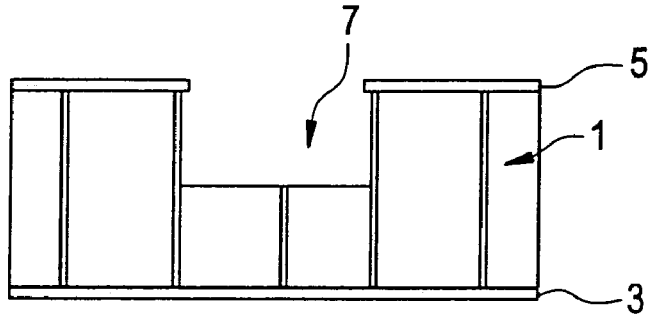

The assembled blocks 1 are then shaped to form a first precursor body 7 prior to removing the cover 5 and the support 3, as shown in FIG. 2. The assembled unmagnetized blocks 1 are shaped or machined by any desired method, such as by a water jet. The first precursor body 7 may be shaped into a disc, ring, or any other desired shape suitable for use in an imaging system, such as an MRI system. Since the precursor body 7 is unmagnetized, it may be readily machined into a desired shape without concern that it would become demagnetized during machining. The post assembly shaping or machining thus allows for improved field homogeneity and reduced shimming time.

Figure 3:
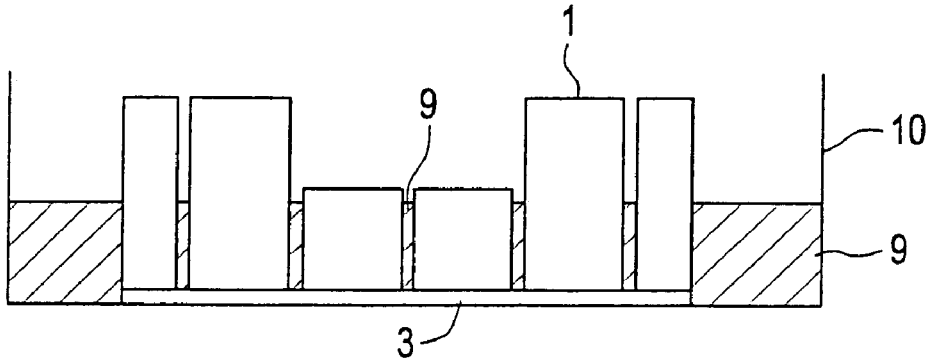

The cover sheet 5 is then removed and an adhesive material 9 is provided to adhere the blocks 1 of the precursor body 7 to each other, as shown in FIG. 3. For example, the shaped blocks 1 attached to the support sheet 3 are placed into an epoxy pan 10, and an epoxy 9, such as Resinfusion 8607 epoxy, is provided into the gaps between the blocks 1. If desired, sand, chopped glass or other filler materials may also be provided into the gaps between blocks 1 to strengthen the bond between the blocks 1. Preferably, the epoxy 9 is poured to a level below the tops of the blocks 1. The support sheet 3 is then removed. Alternatively, while less preferred, the assembled blocks 1 may be shaped, such as by a water jet, after being bound with epoxy 9.

Furthermore, if desired, release sheets may be attached to the exposed inside and outside surfaces of the block assemblies prior to pouring the epoxy 9. The release sheets are removed after pouring the epoxy 9 to expose bare surfaces of the blocks 1. If desired, a glass/epoxy composite may be optionally wound around the outside diameters of the assembled blocks to 2-4 mm, preferably 3 mm, for enhanced protection.

In a first preferred embodiment of the present invention, the permanent magnet body or assembly comprises at least two laminated sections. Preferably, these sections are laminated in a direction perpendicular to the direction of the magnetic field (i.e., the thickness of the sections is parallel to the magnetic field direction). Most preferably, each section is made of a plurality of square, hexagonal, trapezoidal, annular sector or other shaped blocks adhered together by an adhesive substance. An annular sector is a trapezoid that has a concave top or short side and a convex bottom or long side.

Figure 4:
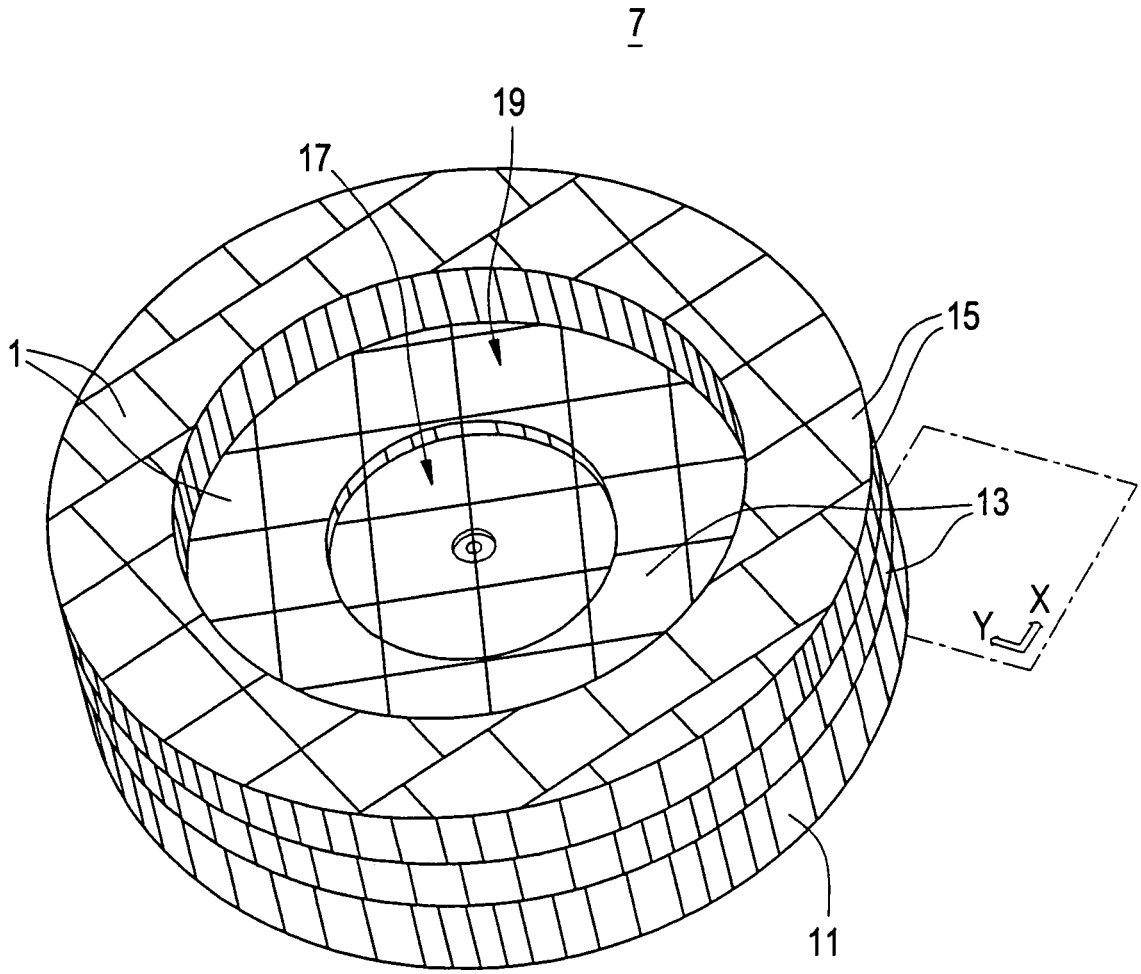
FIG. 4 is a perspective view of an exemplary permanent magnet body according to the first preferred embodiment of the present invention.

One preferred configuration of the body 7 is shown in FIG. 4. The body 7 comprises a disc shaped base section 11, a ring shaped top section 15 and an optional intermediate section 13. The intermediate section 13 is also disc shaped and contains a cavity 17 which is aligned with the opening 19 in the top section to provide a stepped surface which is adapted to face an imaging volume of an imaging system. Each of the sections 11, 13 and 15 may be made from blocks 1 according to the method shown in FIGS. 1-3.

After the sections 11, 13 and 15 shown in FIG. 4 are formed, they are attached to each other by providing a layer of adhesive between them. The adhesive layer may comprise epoxy with sand and/or glass or CA superglue. It should be noted that the permanent magnet body 7 may have any desired configuration other than shown in FIG. 4, and may have one, two, three or more than three sections. Preferably, the bodies 11, 13 and 15 are rotated 15 to 45 degrees, most preferably about 30 degrees with respect to each other, to interrupt continuous epoxy filled channels from propagating throughout the entire structure.

The precursor body 7 is then magnetized to form a permanent magnet body after the unmagnetized blocks 1 are assembled, machined and adhered. The precursor body may be magnetized before being mounted into an imaging system. However, in a preferred aspect of the first embodiment, the precursor body is magnetized after it is attached to a support of an imaging system, such as a yoke of an MRI system.

The unmagnetized material of the precursor body may be magnetized by any desired magnetization method after the precursor body or bodies is/are attached to the yoke or support. For example, the preferred step of magnetizing the first precursor body comprises placing a coil around the first precursor body, applying a pulsed magnetic field to the first precursor body to convert the unmagnetized first precursor body into a first permanent magnet body, and removing the coil from the first permanent magnet body.

Figure 5:
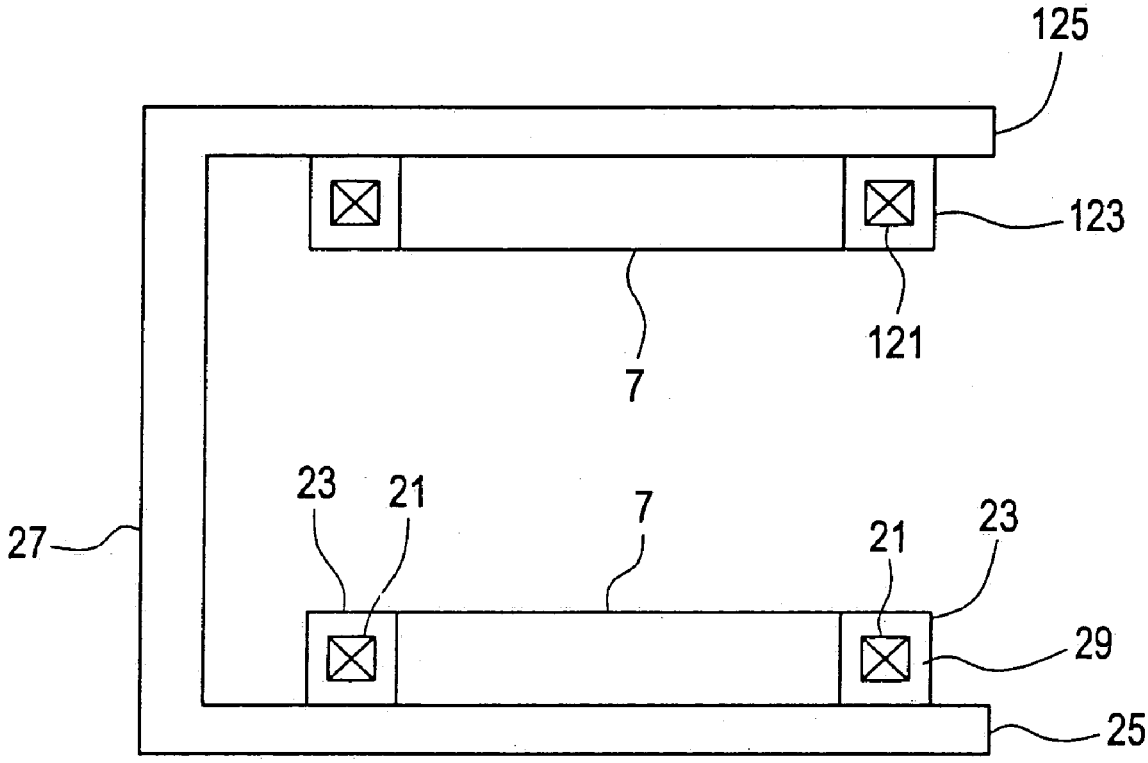
FIG. 5 is a side cross sectional view of a device used to magnetize a permanent magnet mounted in an MRI system according to the first preferred embodiment of the present invention.
Figure 6:
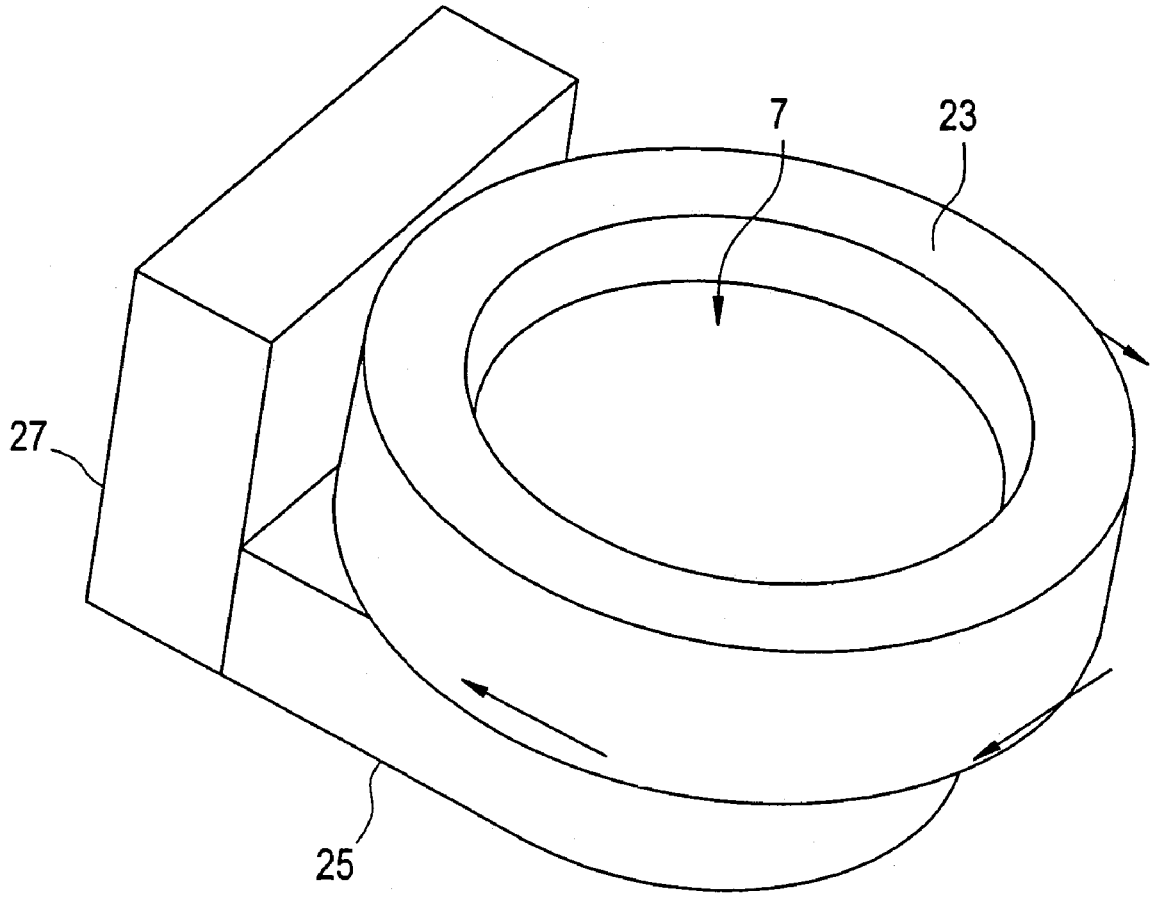
FIG. 6 is a perspective view of the device of FIG. 5.

Preferably, the coil 21 that is placed around the precursor body 7 is provided in a housing 23 that fits snugly around the precursor body 7, as shown in FIGS. 5 and 6. The precursor body 7 is located on a portion 25 of a support of an imaging system, such as an MRI, MRT or NMR system. For example, the support may comprise a yoke 27 of an MRI system, as shown in FIGS. 5 and 6. For example, for a precursor body 7 having a cylindrical outer configuration, the housing 23 comprises a hollow ring whose inner diameter is slightly larger than the outer diameter of the precursor body 7. The coil 21 is located inside the walls of the housing 23, as shown in FIG. 5.

Preferably, a cooling system is also provided with the housing 23 to improve the magnetization process. For example, the cooling system may comprise one or more cooling fluid flow channels 29 inside the walls of the housing 23. The cooling fluid, such as liquid nitrogen, is provided from a cooling fluid reservoir or tank (not shown in FIGS. 5 and 6) through the channels 29 during the magnetization step. Preferably, a directional magnetic field above 1.5 Tesla, most preferably above 2.0 Tesla, is provided by the coil to magnetize the unmagnetized material of the precursor body or bodies. The housing 23 containing the coil 21 is removed from the imaging system after the permanent magnet is magnetized.

If the imaging system, such as an MRI system, contains more than one permanent magnet, then such magnets may be magnetized simultaneously or sequentially. For example, as shown in FIG. 5, two housings 23, 123 containing coils 21, 121 may be used to simultaneously magnetize two precursor bodies 7 that are attached to opposite yoke 27 portions 25, 125. Alternatively, one housing 23 containing the coil 21 may be sequentially placed around each precursor body 7 of the imaging system to sequentially magnetize each precursor body. The precursor bodies 7 may be magnetized before or after placing pole pieces into the MRI system.

In one preferred aspect of the present invention, the permanent magnet material may comprise any permanent magnet material or alloy, such as CoSm, NdFe or RMB, where R comprises at least one rare earth element and M comprises at least one transition metal, for example Fe, Co, or Fe and Co. Most preferably, the permanent magnet comprises a praseodymium (Pr) rich RMB alloy as disclosed in U.S. Pat. No. 6,120,620, incorporated herein by reference in its entirety. The praseodymium (Pr) rich RMB alloy comprises about 13 to about 19 atomic percent rare earth elements (preferably about 15 to about 17 percent), where the rare earth content consists essentially of greater than 50 percent praseodymium, an effective amount of a light rare earth elements selected from the group consisting of cerium, lanthanum, yttrium and mixtures thereof, and balance neodymium; about 4 to about 20 atomic percent boron; and balance iron with or without impurities. As used herein, the phrase "praseodymium-rich" means that the rare earth content of the iron-boron-rare earth alloy contains greater than 50% praseodymium. In another preferred aspect of the invention, the percent praseodymium of the rare earth content is at least 70% and can be up to 100% depending on the effective amount of light rare earth elements present in the total rare earth content. An effective amount of a light rare earth elements is an amount present in the total rare earth content of the magnetized iron-boron-rare earth alloy that allows the magnetic properties to perform equal to or greater than 29 MGOe $(BH)_{max}$ and 6 kOe intrinsic coercivity (Hci). In addition to iron, M may comprise other elements, such as, but not limited to, titanium, nickel, bismuth, cobalt, vanadium, niobium, tantalum, chromium, molybdenum, tungsten, manganese, aluminum, germanium, tin, zirconium, hafnium, and mixtures thereof. Thus, the permanent magnet material most preferably comprises 13-19 atomic percent R, 4-20 atomic percent B and the balance M, where R comprises 50 atomic percent or greater Pr, 0.1-10 atomic percent of at least one of Ce, Y and La, and the balance Nd.

II. The Second Preferred Embodiment: The Recoil Pulse

According to the second preferred embodiment of the present invention, the magnetization of the permanent magnets in an imaging system may be stabilized by applying a recoil pulse to the permanent magnet after it is magnetized. Thus, a precursor body having a shape suitable for use in an imaging system is first magnetized by applying a pulsed magnetic field having a first magnitude and a first direction to the precursor body to convert the precursor body to the permanent magnet body. For example, the precursor body may be magnetized after assembly of the blocks. Preferably, the precursor body is magnetized after it is mounted to a support of an imaging system, such as an MRI system, as described with respect to the first preferred embodiment, above. One or more recoil pulses are then applied to the permanent magnet body. The recoil pulse(s) has a second magnitude smaller than the first magnitude of the magnetizing pulses. The recoil pulse(s) has a second direction opposite from the first direction of the magnetizing pulses. As described herein, "second direction opposite from the first direction" means that the second direction differs from the first direction by about 180 degrees (i.e., by exactly 180 degrees or by 180 degrees plus or minus a small unavoidable deviation due to magnetization equipment errors).

In a preferred aspect of the second preferred embodiment, the recoil pulse is applied by the same coil 21 as was used to magnetize the precursor body 7, as shown in FIGS. 5 and 6. The same pulsed magnet (i.e., coil 21) may be used to apply the recoil pulse by reversing a polarity of the coil's power supply or by manually reversing the leads from the power supply, after the step of applying a pulsed magnetic field and before the step of providing at least one recoil pulse. However, if desired, a separate recoil pulse coil may be placed around each permanent magnet body to apply the recoil pulse.

While not wishing to be bound by any particular theory, the present inventors believe that the recoil pulse prevents or reduces unpredictable magnetization changes in the permanent magnet during the operation of the imaging system by the following mechanism (i.e., the recoil pulse prevents or reduces the demagnetization of the permanent magnet during the application of the gradient pulses). After the precursor body is magnetized to form a permanent magnet body by applying a pulsed magnetic field, a plurality of domains in the permanent magnet body remain only partially magnetized. The spins in these partially magnetized domains are unstably aligned in a first direction after magnetization but prior to applying the recoil pulse. During the use of the imaging system, gradient fields are applied to the permanent magnet body. These gradient fields may cause the unstably aligned spins in the partially magnetized domains to change direction to another direction which different from the first direction. The change in the spin direction in the partially magnetized domains causes a change in the magnetization of the permanent magnet.

The at least one recoil pulse aligns at least a portion of these unstably aligned spins in the plurality of the partially magnetized domains in a second direction opposite to the first direction. Thus, these partially magnetized domains become fully magnetized, albeit having stably aligned spins in the opposite direction from the majority of the domains of permanent magnet body. Therefore, since these domains are fully magnetized and the spins are stably aligned, the gradient fields applied to the permanent magnet during the operation of the imaging system are less likely to cause the spins to change direction. Thus, the magnetization changes in the permanent magnet during the operation of the imaging system are prevented or reduced by the application of the at least one recoil pulse. The permanent magnet made by the process of the second preferred embodiment exhibits an improved field homogeneity during gradient pulse sequences compared to a conventional permanent magnet. Most preferably, substantially no domains in the permanent magnet body become demagnetized during an application of a gradient field to the permanent magnet body, which has been subjected to the recoil pulse.

III. The Third Preferred Embodiment: Magnetization At Elevated Temperatures

According to the third preferred embodiment of the present invention, the energy required for magnetization may be reduced by magnetizing the precursor body above room temperature. Thus, the precursor body is heated above room temperature during the step of magnetization.

Preferably, the precursor body is heated above room temperature and below the Curie temperature of the permanent magnet material during the step of magnetizing the precursor body. More preferably, the precursor body is heated to a temperature of about 40 to about 200° C. during the step of magnetization. Most preferably, the precursor body is heated to a temperature of about 50 to about 100° C. during the step of magnetization.

The precursor body may also be heated prior to and after the application of the pulsed magnetic field used to magnetize the precursor body. Any method of heating the precursor body may be used. For example, the precursor body may be heated by placing a heating tape around the first precursor body and activating the heating tape. The precursor body may be heated by attaching surface heaters the first precursor body and activating the surface heaters. The precursor body may also be heated by placing the first precursor body in a furnace. The precursor body may also be heated by directing radiation from a heating lamp on the precursor body.

Preferably, the method of the third preferred embodiment is used together with the method of the first preferred embodiment. Thus, the precursor body is heated and magnetized after the blocks comprising the precursor body are assembled. Most preferably, the precursor body is attached to the support of the imaging system before the precursor body is heated and magnetized. However, if desired, the precursor blocks may be first heated and magnetized prior to being assembled into a precursor body. It is also preferable, but not required, to follow up the magnetization with one or more recoil pulses of the second preferred embodiment. If desired, the permanent magnet body may also be heated during the application of the recoil pulse(s).

Figure 7:
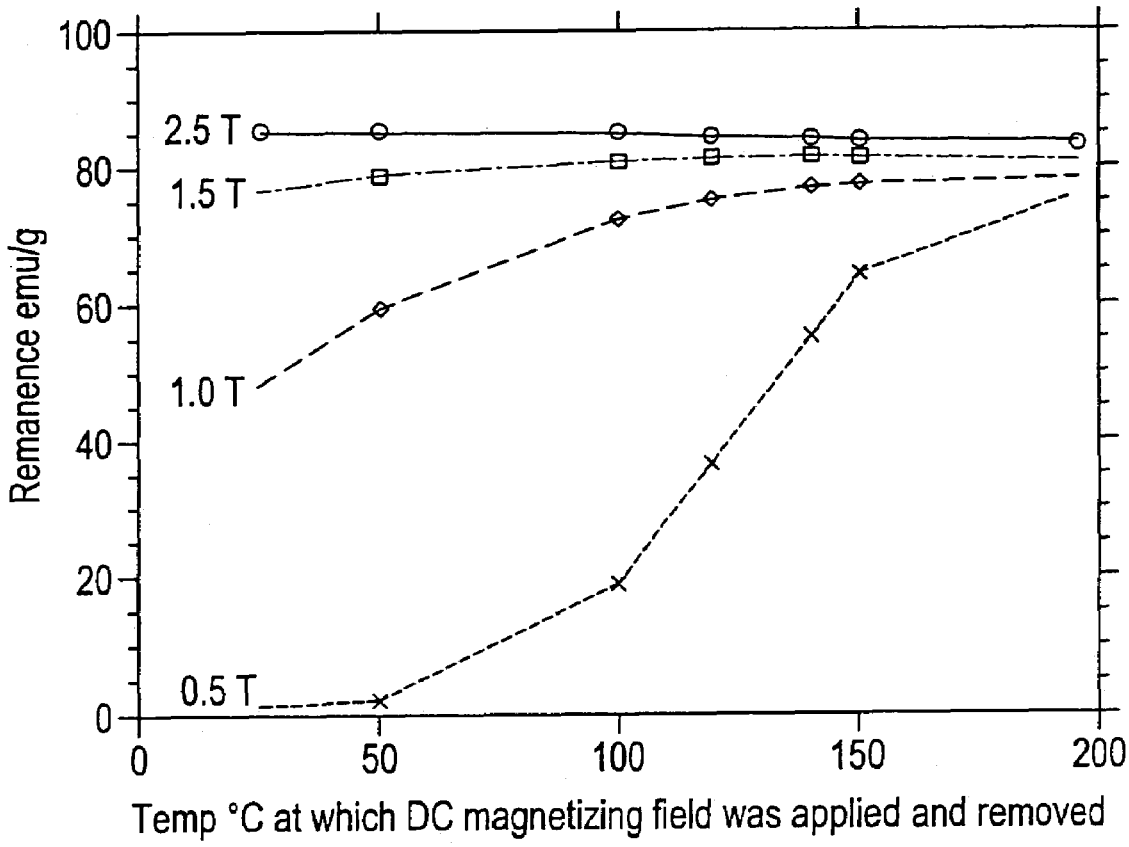
FIG. 7 is plot of remanence versus magnetization temperature of permanent magnets according to the second preferred embodiment of the present invention.

FIG. 7 is a plot of remanence (in units of emu/g) versus temperature at which a DC magnetizing field was applied and removed to a NdFeB precursor material for different strengths of the magnetizing field. The NdFeB permanent magnet was cooled in the remanent field. The same precursor material was used for each point on the plot. The magnetized permanent magnet was demagnetized at the start of each run to convert it back to the precursor material by heating it above the Curie temperature. The precursor material was magnetized with a 0.5 T, 1.0 T, 1.5 T and 2.5 T magnetizing fields at 50, 100, 120, 140 and 150° C. The precursor material was also magnetized with the 2.5 T magnetizing field at 25° C. and 195° C. The measured remanence values are plotted in FIG. 7. As may be seen from FIG. 7, the remanence generally increases with increasing temperatures for the same magnetizing fields, especially for the 0.5 T and 1.0 T magnetizing fields. The permanent magnets were 92% saturated at 50° C. and 95% saturated at 100° C.

IV. The Fourth Preferred Embodiment: Battery Power Source.

The magnetization of the precursor body may also be improved by using a pulsed magnet assembly with a battery power supply. By using a power supply containing one or more batteries, the cost, reliability, ease of operation and construction of the pulsed magnet used to magnetize the precursor body is improved. The pulsed magnet assembly contains a power supply comprising at least one battery, a switching circuit and an electromagnet adapted to magnetize a permanent magnet precursor material. The electromagnet is preferably a coil which contains no core, and which is adapted to fit around the precursor body, such that the precursor body acts as a core of the electromagnet during magnetization.

Figure 8:
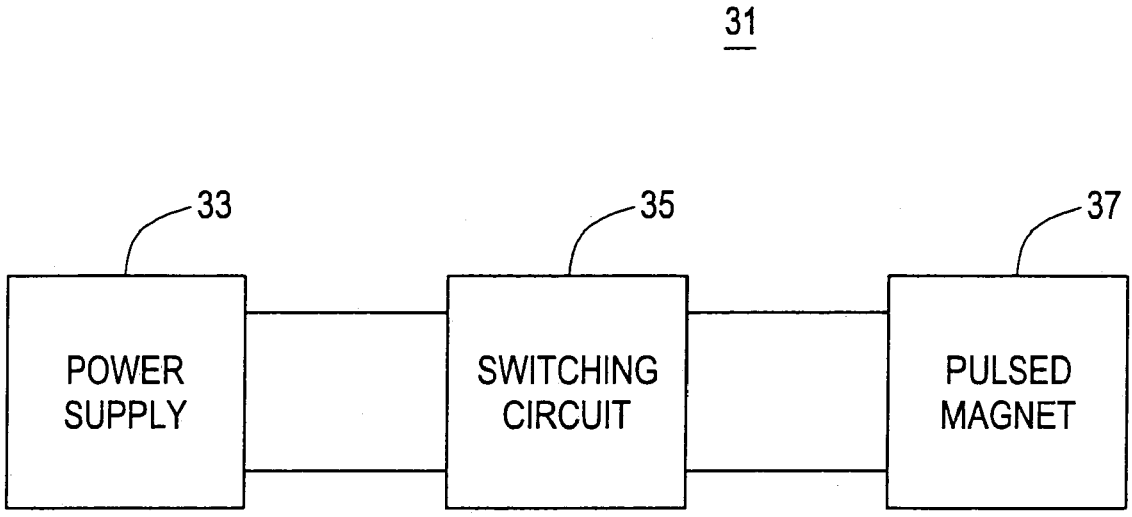
FIG. 8 is schematic of a pulsed magnet assembly according to the fourth preferred embodiment of the present invention.

FIG. 8 is a schematic diagram of the pulsed magnet assembly 31 of the fourth preferred embodiment. The assembly contains a power supply 33 which comprises at least one battery, a switching circuit 35, and a pulsed electromagnet 37. In use, the switching circuit 35 switches the power from the power supply 33 on and off, such that a pulsed current is provided to the electromagnet 37. The electromagnet 37 may comprise any device which may generate a pulsed magnetic field upon application of power from the power supply 33. For example, the electromagnet 37 may comprise the coil 21 shown in FIG. 5, which is adapted to fit around the precursor body 7.

In use, the pulsed magnet 37 is placed adjacent to the first precursor body 7. The first precursor body 7 is then magnetized to form a first permanent magnet body by energizing the pulsed magnet from the power supply 33 comprising at least one battery.

The step of placing the pulsed magnet adjacent to the first precursor body preferably comprises placing the coil 21 around the precursor body 7 after the precursor body has been mounted to the imaging system support, as described with respect to the first preferred embodiment. However, if desired, the pulsed magnet assembly containing a battery power source may be used to magnetize individual precursor blocks prior to assembling the blocks into the precursor body, or to magnetize the precursor body prior to mounting the precursor body onto the imaging system support. The step of magnetizing preferably comprises providing a current from a plurality of batteries of the power supply 33 to the coil 21 to generate a pulsed magnetic field having a first magnitude and a first direction. The switching circuit 35 switches the current on and off to generate the pulsed magnetic field. If desired, the pulsed magnet assembly 31 may also be used to apply at least one recoil pulse to the magnetized permanent magnet material, as described with respect to the second preferred embodiment.

In a preferred aspect of the fourth embodiment, the pulsed magnet assembly 31 is used to magnetize the precursor body that is heated above room temperature according to the third preferred embodiment of the present invention. The current required to energize the electromagnet to magnetize the precursor body depends on the temperature of the precursor body. Since the pulsed magnetic field required to magnetize the precursor body decreases with increasing temperature of the precursor body, by heating the precursor body, the minimum current required to energize the coil is reduced. Therefore, by heating the precursor material during magnetization, a power supply which provides a lower amount of power, such as a battery power supply, may be used to magnetize the precursor body. In one preferred aspect of the fourth embodiment, the pulsed magnet assembly 31 is used together with a heating element adapted to heat the permanent magnet precursor material (i.e., the precursor body or blocks). The heating element 32 may comprise heating tape, surface heaters, a furnace and/or a heating lamp. In another preferred aspect of the fourth embodiment, the pulsed magnet assembly 31 is provided together with the heating element as a kit for magnetizing a permanent magnet precursor material.

Figure 9:
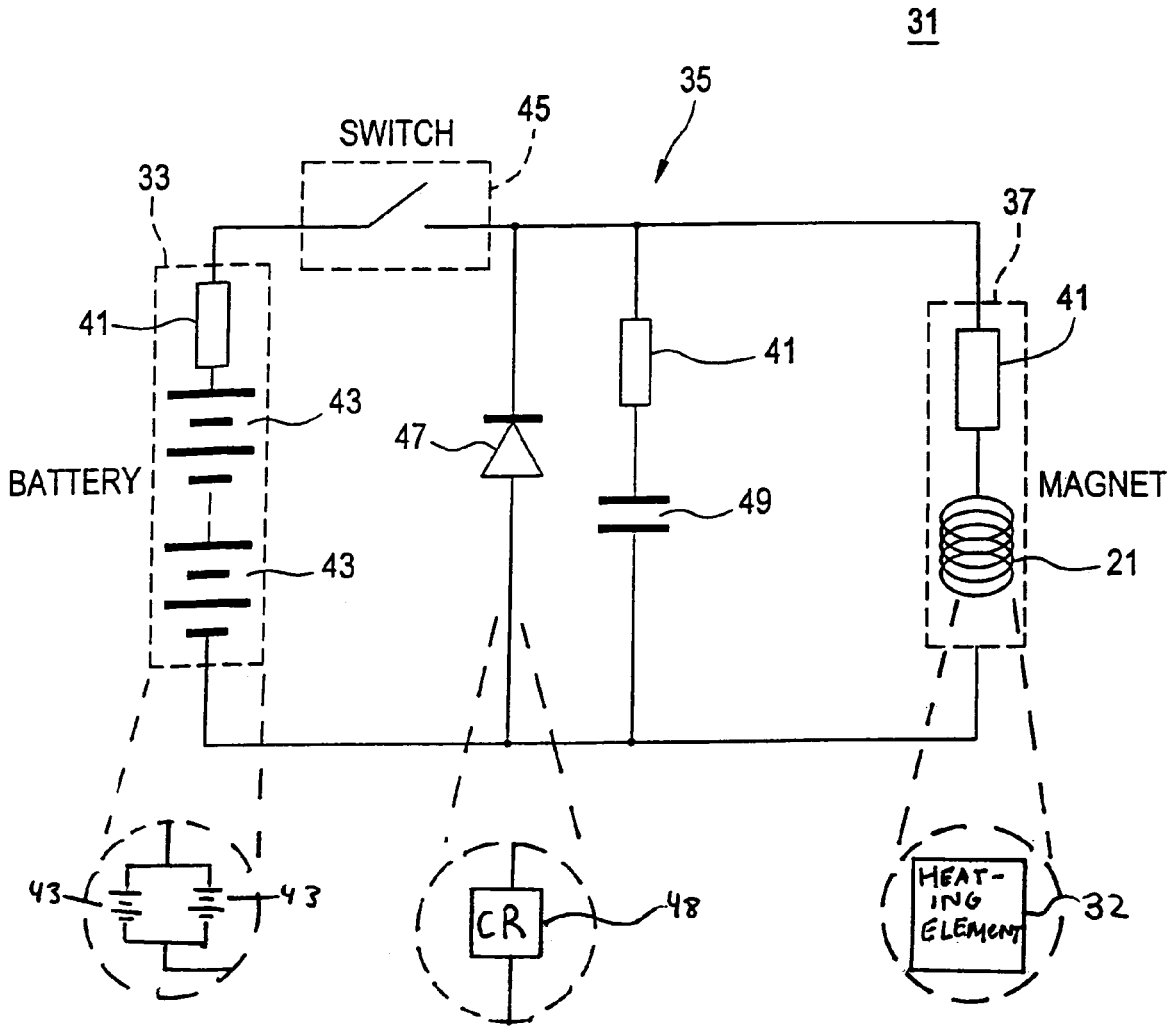
FIG. 9 is a circuit diagram of the pulsed magnet assembly of FIG. 8.

FIG. 9 illustrates a circuit diagram of the pulsed magnet assembly 31 according to a preferred aspect of the fourth embodiment. However, any other suitable circuit schematic may be used for the assembly 31, as desired. The circuit contains a plurality of resistance elements. 41. In this circuit, the power supply 33 contains one or more batteries 43, such as 2-100 batteries. The batteries may be arranged in series, in parallel or both in series and in parallel, depending on the required voltage and current. For example, batteries arranged in series provide a high voltage, and may be used to magnetize a small permanent magnet. Batteries arranged in parallel provide a high current and may be used to magnetize a large permanent magnet.

The batteries 43 may comprise any desired battery type. For example, the batteries 43 may comprise 12V batteries having an internal resistance of 2 to 10 milliohms, preferably 2.8 to 8 milliohms. For example, 7 milliohm 12V batteries that are readily available on the market, as well as more expensive 2.8 milliohm 12V batteries marketed under the brand name Optim® may be used in the power supply. If desired, the power supply 33 may contain other power generating components in addition to the battery or batteries 43.

The switching circuit 35 of the assembly contains a switch 45. For example, the switch may comprise a thyristor or a magnetically operated switch, such as a DC contactor, controlled by a triggering circuit. The current pulse duration is adjusted by the timing of the switch 45. The timing of the switch may be controlled by a pulse generation circuit or a computer controlled trigger. When the switch is closed, the current flows in the loop from the batteries 43 to the electromagnet 37 (such as coil 21).

The switching circuit also preferably contains an optional diode 47 and an optional capacitor 49 in parallel with the batteries 43. When the switch 45 is opened, the energy present in the electromagnet 37 is transferred into Joule heating inside the electromagnet through the diode 47. Thus, the diode 47 allows easier switch 45 opening when a high current is provided into the loop. If desired, an optional Coulomb resistance 48 may be added in series with the diode 47.

One or more pulses are provided to magnetize the precursor material. The rise time of the pulse is determined by the time constant of the circuit. The pulse waveform may be easily adjusted by the timing of the switch. For example, the pulse width may be 10 to 40 seconds, preferably 15 to 25 seconds, most preferably 20 seconds. The pulse rise time may be the same or slightly different than the fall time. For example, for a 20 second pulse width, the rise time may be about 12 seconds and the fall time may be about 8 seconds. If the voltage provided by the power supply is increased, then higher peak current may be reached to magnetize the precursor material, or the pulse duration may be shortened, due to a decreased rise time required to reach the same peak current value. Therefore, by increasing the voltage higher pulsed magnetization field can be attained.

The peak current is determined by the ratio of the voltage to the resistance, which is a function of time due to the Joule heating and magnetoresistance. Thus, to obtain a higher peak current, the pulsed magnet is preferably cooled with a cooling fluid, such as liquid nitrogen, to lower the resistance, as discussed with respect to the first preferred embodiment. Therefore, while the coil 21 is preferably cooled, the precursor material 7 is preferably heated.

The current provided to the pulsed electromagnet may range from 200 to 3,000 KAmp-turns, preferably 400 to 800 KAmp-turns, most preferably 500 KAmp-turns (i.e., the current is provided in the units of kiloamperes times the number of turns of the coil 21). For example, a 2,000 Amp current provided to a coil having 500 turns provides a 1,000 KAmp-turns current.

V. The Preferred MRI System

As is evident from the above description, the methods and apparatus for magnetizing a permanent magnet of the first four embodiments may be used separately, or in any desired combination. Table I below illustrates the fifteen possible combinations of the four preferred embodiments of the present invention.

TABLE I

| Combination | Embodiment I | Embodiment II | Embodiment III | Embodiment IV |
|---|---|---|---|---|
| 1 | X | | | |
| 2 | | X | | |
| 3 | | | X | |
| 4 | | | | X |
| 5 | X | X | | |
| 6 | | | X | X |
| 7 | X | | X | |
| 8 | | X | | X |
| 9 | X | | | X |
| 10 | | X | X | |
| 11 | X | X | X | |
| 12 | X | X | | X |
| 13 | X | | X | X |
| 14 | | X | X | X |
| 15 | X | X | X | X |

Figure 10:
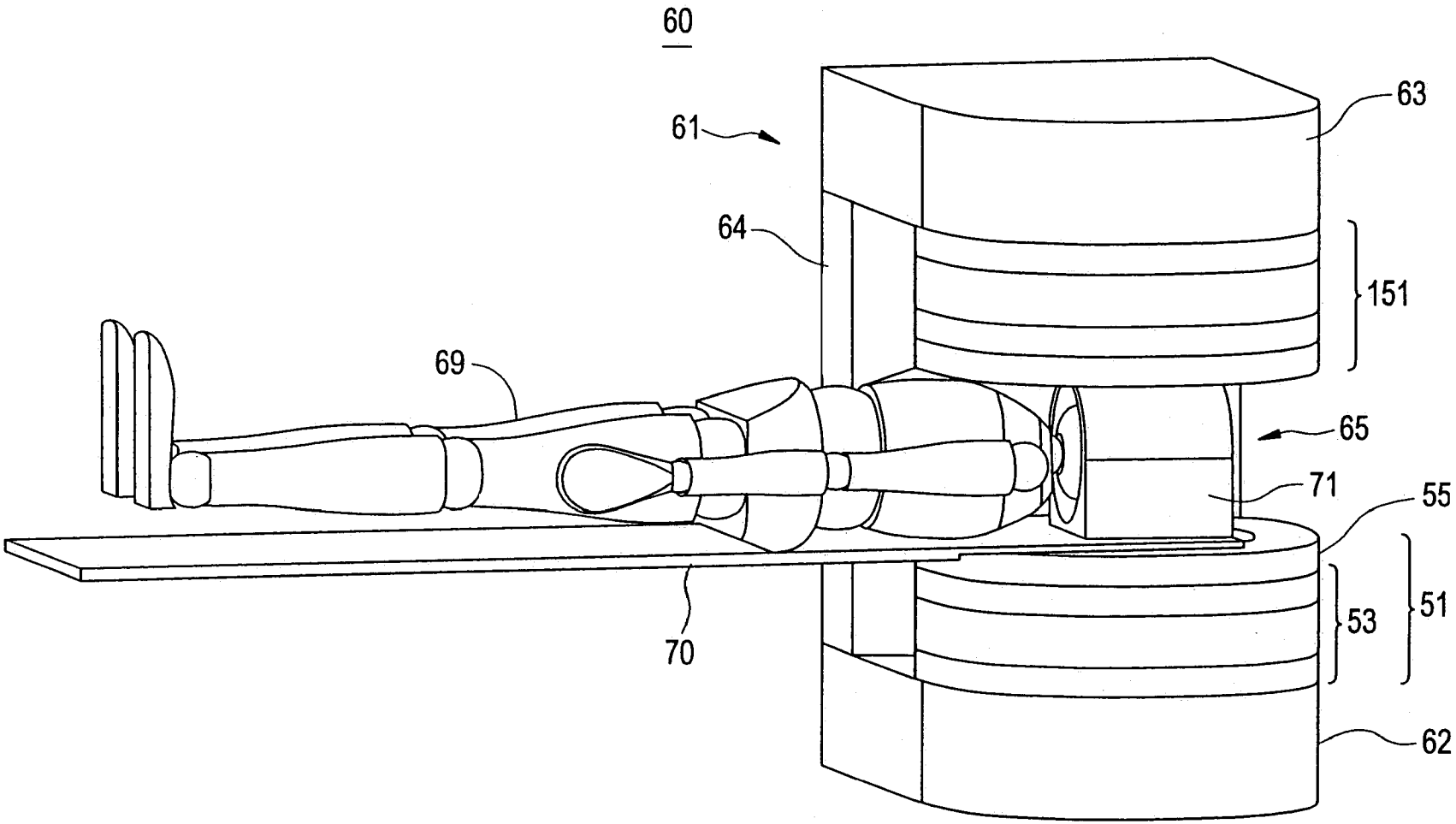
FIG. 10 is a perspective view of an MRI system containing a "C" shaped yoke.
Figure 11:
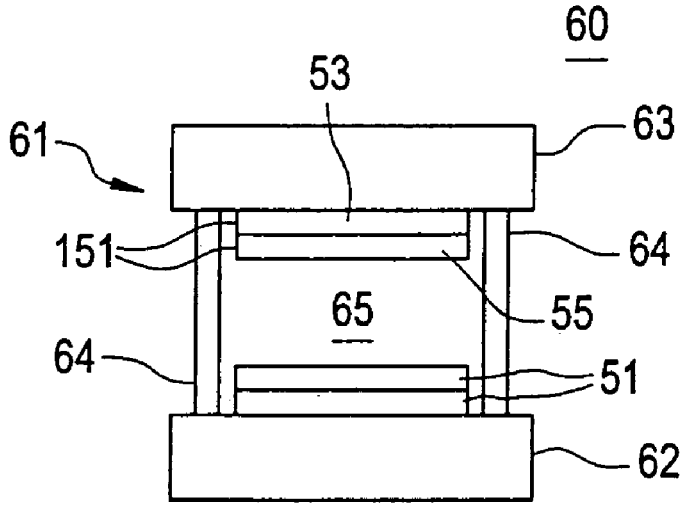
FIG. 11 is a side cross sectional view of an MRI system containing a yoke having a plurality of connecting bars.
Figure 12:
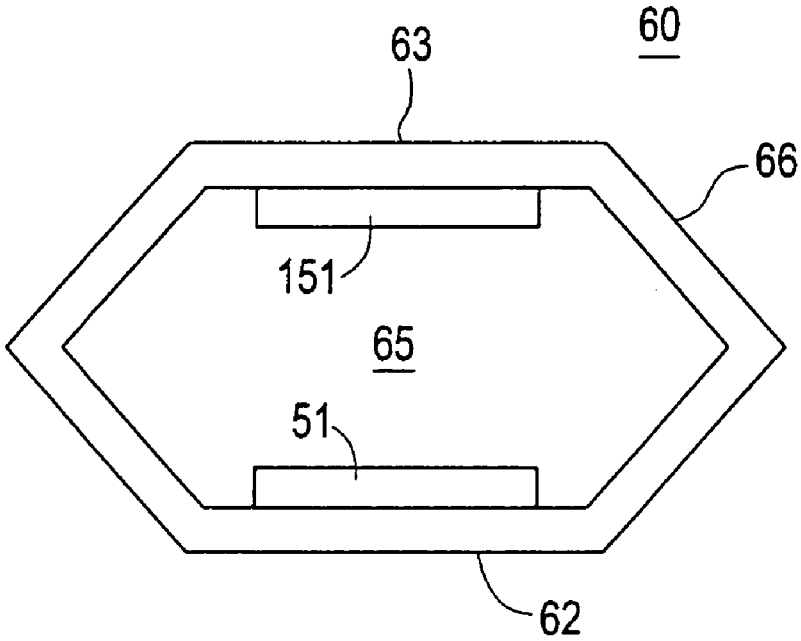
FIG. 12 is a side cross sectional view of an MRI system containing a tubular yoke.

The permanent magnet body made according to the methods of the preferred embodiments of the present invention is preferably used in a magnet assembly of an imaging system, such as an MRI, MRT or NMR system. FIGS. 10, 11 and 12 illustrate preferred MRI systems which contain magnet assemblies 51 which include permanent magnet bodies made by the methods of the preferred embodiments of the present invention. Preferably, at least two magnet assemblies 51 are used in an MRI system.

Each magnet assembly 51 preferably contains a permanent magnet body 53 made by the methods of the preferred embodiment of the present invention. Each magnet assembly may optionally contain a pole piece 55, a gradient coil (not shown), and RF coil (not shown) and shims (not shown). The magnet assemblies are attached to a yoke or a support 60 in an MRI system. However, if desired, the pole piece may be omitted, and at least one layer of soft magnetic material may be provided between the yoke and the permanent magnet body, as disclosed is application Ser. No. 09/824,245, filed on Apr. 3, 2001, incorporated herein by reference in its entirety. The at least one layer of a soft magnetic material preferably comprises a laminate of Fe—Si, Fe—Al, Fe—Co, Fe—Ni, Fe—Al—Si, Fe—Co—V, Fe—Cr—Ni, or amorphous Fe- or Co-base alloy layers.

Any appropriately shaped yoke may be used to support the magnet assemblies. For example, a yoke generally contains a first portion, a second portion and at least one third portion connecting the first and the second portion, such that an imaging volume is formed between the first and the second portion. FIG. 10 illustrates a side perspective view of an MRI system 60 according to one preferred aspect of the present invention. The system contains a yoke 61 having a bottom portion or plate 62 which supports the first magnet assembly 51 and a top portion or plate 63 which supports the second magnet assembly 151. It should be understood that "top" and "bottom" are relative terms, since the MRI system 60 may be turned on its side, such that the yoke contains left and right portions rather than top and bottom portions. The imaging volume is 65 is located between the magnet assemblies.

The MRI system 60 further contains conventional electronic components, such as an image processor (i.e., a computer), which converts the data/signal from the RF coil into an image and optionally stores, transmits and/or displays the image. FIG. 10 further illustrates various optional features of the MRI system 60. For example, the system 60 may optionally contain a bed or a patient support 70 which supports the patient 69 whose body is being imaged. The system 60 may also optionally contain a restraint 71 which rigidly holds a portion of the patient's body, such as a head, arm or leg, to prevent the patient 69 from moving the body part being imaged. The system 60 may have any desired dimensions. The dimensions of each portion of the system are selected based on the desired magnetic field strength, the type of materials used in constructing the yoke 61 and the assemblies 51, 151 and other design factors.

In one preferred aspect of the present invention, the MRI system 60 contains only one third portion 64 connecting the first 62 and the second 63 portions of the yoke 61. For example, the yoke 61 may have a "C" shaped configuration, as shown in FIG. 10. The "C" shaped yoke 61 has one straight or curved connecting bar or column 64 which connects the bottom 62 and top yoke 63 portions.

In another preferred aspect of the present invention, the MRI system 60 has a different yoke 61 configuration, which contains a plurality of connecting bars or columns 64, as shown in FIG. 11. For example, two, three, four or more connecting bars or columns 64 may connect the yoke portions 62 and 63 which support the magnet assemblies 51, 151.

In yet another preferred aspect of the present invention, the yoke 61 comprises a unitary tubular body 66 having a circular or polygonal cross section, such as a hexagonal cross section, as shown in FIG. 12. The first magnet assembly 51 is attached to a first portion 62 of the inner wall of the tubular body 66, while the second magnet assembly 151 is attached to the opposite portion 63 of the inner wall of the tubular body 66 of the yoke 61. If desired, there may be more than two magnet assemblies in attached to the yoke 61. The imaging volume 65 is located in the hollow central portion of the tubular body 66.

The imaging apparatus, such as the MRI 60 containing the permanent magnet assembly 51, is then used to image a portion of a patient's body using magnetic resonance imaging. A patient 69 enters the imaging volume 65 of the MRI system 60, as shown in FIG. 10. A signal from a portion of a patient's 69 body located in the volume 65 is detected by the RF coil, and the detected signal is processed by using the processor, such as a computer. The processing includes converting the data/signal from the RF coil into an image, and optionally storing, transmitting and/or displaying the image.

The preferred embodiments have been set forth herein for the purpose of illustration. However, this description should not be deemed to be a limitation on the scope of the invention. Accordingly, various modifications, adaptations, and alternatives may occur to one skilled in the art without departing from the scope of the claimed inventive concept.

What is claimed is:

1. A kit for magnetizing a permanent magnet precursor material, comprising:

a pulsed electromagnet assembly, comprising:

a power supply comprising at least one battery;

a switching circuit; and a diode connected in parallel with the coil;

the electromagnet adapted to magnetize a permanent magnet precursor material;

a heating element adapted to heat the permanent magnet precursor material;

a casing containing the coil; and a cooling fluid reservoir in communication with the casing, wherein the electromagnet comprises a coil which contains no core, and which is adapted to fit around a body of the permanent magnet precursor material, such that the body acts as a core of the pulsed electromagnet during magnetization.

2. The kit of claim 1, wherein the power supply contains a plurality of batteries connected in series in a loop containing the coil.

3. The kit of claim 1, wherein the power supply contains a plurality of batteries connected in parallel in a loop containing the coil.

4. The kit of claim 1, wherein the power supply contains a plurality of batteries connected in series and in parallel in a loop containing the coil.

5. The kit of claim 1, wherein the heating element comprises at least one of a heating tape, surface heaters, a furnace and a heating lamp.

6. The kit of claim 1, wherein the heating element comprises surface heaters.

7. The kit of claim 1, wherein the heating element comprises a furnace.

8. The kit of claim 1, wherein the heating element comprises a heating lamp.

9. The kit of claim 1, wherein the heating element comprises a heating tape.

10. A pulsed electromagnet assembly, comprising:

a power supply comprising at least one battery;

a first means for magnetizing a permanent magnet precursor material;

a diode connected in parallel with the first means;

a second means for switching the first means on and off; and a third means for heating the permanent magnet precursor material during magnetization, wherein the first means is a means for applying at least one recoil pulse to the precursor material after applying a pulsed magnetic field to the precursor material to magnetize the precursor material.

11. The assembly of claim 10, wherein the first means is a means for applying a pulsed magnetic field to the precursor material comprising a plurality of precursor material blocks to magnetize the precursor material.

12. The assembly of claim 10, wherein the first means is a means for magnetizing a permanent magnet precursor material into a permanent magnet for an MRI system.

* * * * *